United States Patent [19]

Ben-Gal et al.

[11] Patent Number: 4,685,679

[45] Date of Patent: Aug. 11, 1987

[54] LABYRINTH PUZZLE

[76] Inventors: Ofer Ben-Gal, Simtat Avivim 6, Kfar Saba; Nissim Sabatov, Ir HaYona 11, Tel Aviv, both of Israel

[21] Appl. No.: 826,088

[22] Filed: Feb. 4, 1986

[51] Int. Cl.[4] ..... A63F 9/08

[52] U.S. Cl. ..... 273/153 R; 273/109; 273/155

[58] Field of Search ..... 273/153 R, 109, 1 GB, 273/155, 110

[56] References Cited

U.S. PATENT DOCUMENTS

| | | | |
|---|---|---|---|
| 479,475 | 7/1892 | Stutz | 273/109 |
| 598,889 | 2/1898 | Young | 273/153 R |
| 600,696 | 3/1898 | Patterson | 273/153 R X |
| 1,071,874 | 9/1913 | Burbank | 273/153 R |
| 4,570,935 | 2/1986 | Stefanini | 273/153 R |

FOREIGN PATENT DOCUMENTS

| | | | |
|---|---|---|---|
| 32319 | 10/1923 | Denmark | 273/109 |
| 637124 | 12/1978 | U.S.S.R. | 273/153 R |

*Primary Examiner*—Anton O. Oechsle

*Attorney, Agent, or Firm*—Abelman Frayne Rezac & Schwab

[57] ABSTRACT

A type of labyrinth puzzle comprising a variable path labyrinth comprising first and second labyrinth defining portions which are movable with respect to each other.

4 Claims, 15 Drawing Figures

LABYRINTH PUZZLE

FIELD OF THE INVENTION

The present invention relates to toys generally and more particularly to manipulative puzzles.

BACKGROUND OF THE INVENTION

Various types of manipulative puzzles exist, including labyrinth type puzzles, wherein a player attempts to cause movement of a ball or other object through a labyrinth to a given location.

The prior art known to Applicant involves a labyrinth base and an object, which are movable with respect to each other.

SUMMARY OF THE INVENTION

The present invention seeks to provide a new and more challenging type of labyrinth puzzle comprising a variable path labyrinth comprising first and second labyrinth defining portions which are movable with respect to each other.

Further in accordance with a preferred embodiment of the invention, the first and second labyrinth defining portions together define the variable path.

Additionally in accordance with a preferred embodiment of the present invention, each of the first and second labyrinth defining portions includes a partial groove, whereby spatial correspondence of the partial grooves permits passage of a labyrinth traversing element.

Further in accordance with an embodiment of the invention, the first and second labyrinth defining portions are arranged for relative rotation.

Additionally in accordance with an embodiment of the invention, at least one of the first and second labyrinth defining portions is hidden from the view of the player.

Further in accordance with an embodiment of the invention, the partial grooves on the first and second labyrinth defining portions are not registrable.

Additionally in accordance with an embodiment of the invention, at least one of the partial grooves on the first and second labyrinth defining portions comprises a broadened area in which free motion of a labyrinth traversing element is permitted.

Further in accordance with an embodiment of the invention, the labyrinth traversing element may be magnetic and movable through the labyrinth with the aid of a magnet.

In accordance with an embodiment of the invention, the variable path is generally flat. Alternatively, the variable path may be formed on a surface of rotation or on any other non-flat surface.

In accordance with one embodiment of the invention a single labyrinth traversing element is associated with the labyrinth at a given time. According to an alternative embodiment of the invention, a plurality of labyrinth traversing elements are associated with the labyrinth at a given time.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
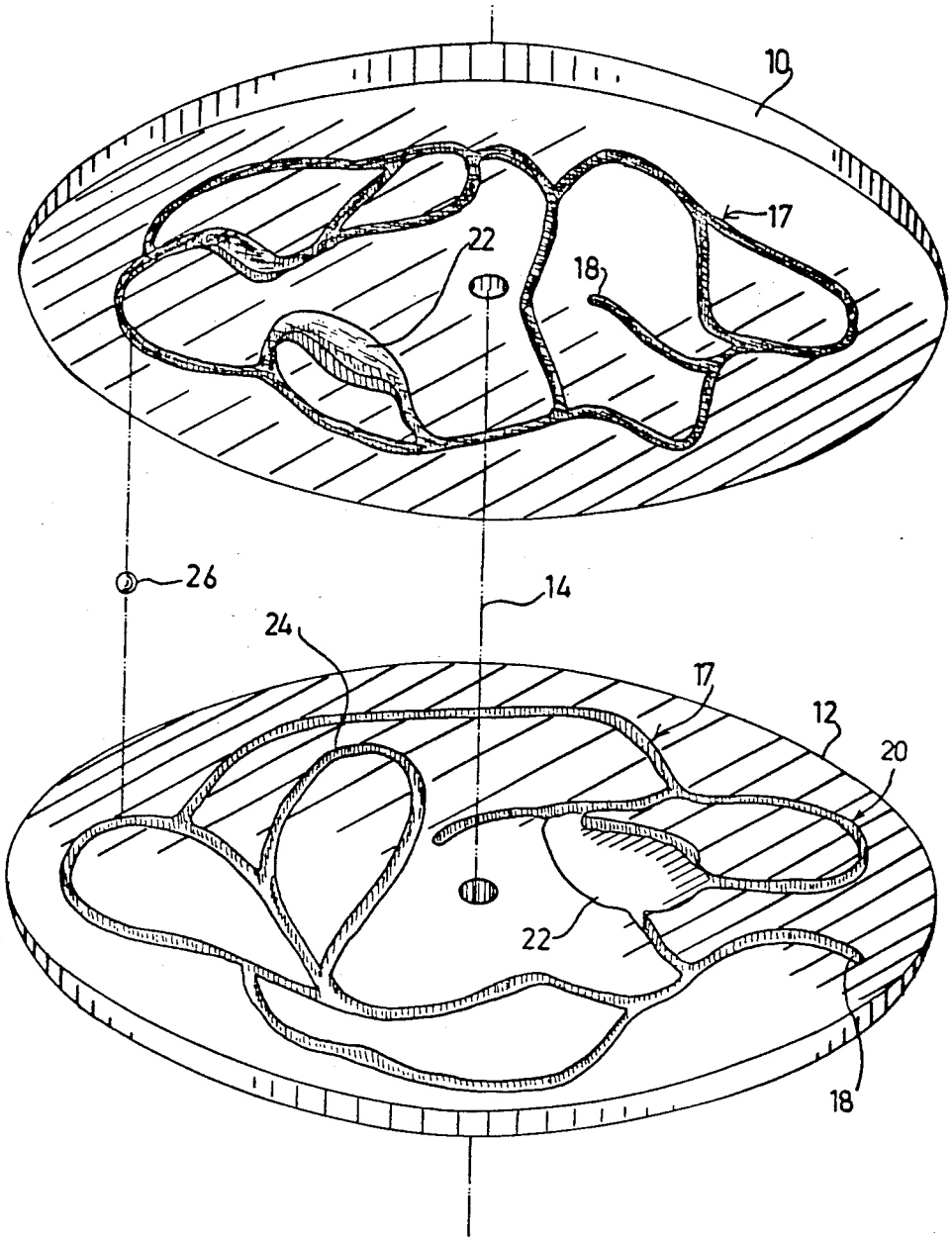
FIG. 1 is an exploded view illustration of a labyrinth puzzle constructed and operative in accordance with a preferred embodiment of the present invention.
Figure 2:
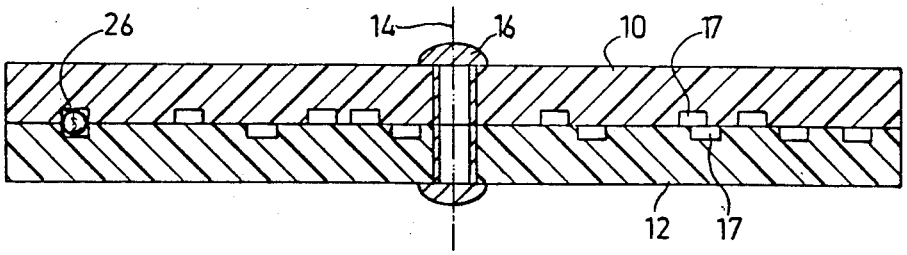
FIG. 2 is a sectional illustration of the assembled labyrinth puzzle of FIG. 1 taken along a line through its center.

Reference is now made to FIGS. 1 and 2 which show a labyrinth puzzle constructed and operative in accordance with a preferred embodiment of the present invention.

The labyrinth puzzle comprises first and second labyrinth defining portions 10 and 12, here shown in the form of planar disks. Portions 10 and 12 are arranged in juxtaposed relationship for relative rotation about a central rotation axis 14 and are typically secured together by suitable fastening means 16.

According to a preferred embodiment of the present invention, the juxtaposed surfaces of portions 10 and 12 are formed with partial grooves 17, which define a labyrinthine path, which may include dead ends 18, curves 20, broadened areas 22, loops 24, etc.. By "partial grooves", there is meant a groove whose depth is insufficient to permit full seating therein of a labyrinth traversing element 26, such as a ball.

According to a preferred embodiment of the invention, as noted above, portions 10 and 12 are each formed with partial grooves. According to an alternative embodiment of the invention, portions 10 and 12 may be formed with complete grooves in which a labyrinth traversing element can be fully seated.

In the preferred embodiment of the invention, the partial grooves 17 on portions 10 and 12 respectively are not identical and therefore cannot be brought into complete registration. Rather only portions of the two facing juxtaposed partial grooves may be brought into registration at any given relative position of the two portions.

It may be appreciated that, in this way, a labyrinth following element may be caused to pass through a labyrinth by sequential relative repositioning of the rotatably joined portions 10 and 12 from a starting location to a desired end location.

According to one alternative embodiment of the invention, both of the grooves 17 may be seen by a player;

according to an alternative embodiment of the invention, only some, part or none of the grooves may be seen by a player.

Reference is now made to FIGS. 3-10, which illustrate the design of the grooves 17 and their operation. In all of these figures, solid lines indicate a part of the partial groove 17 on portion 10, while dashed lines indicate a part of the partial groove 17 on portion 12.

Figure 3:
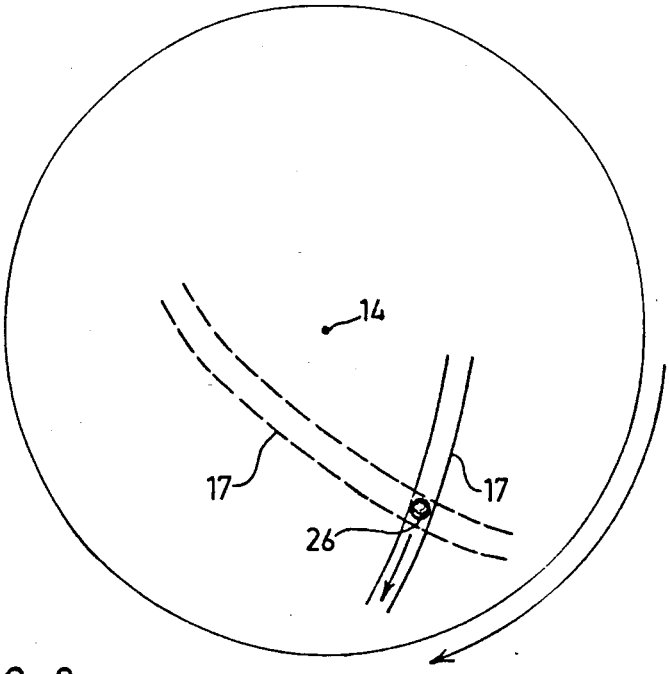
FIG. 3 is a diagrammatic illustration of a portion of a variable path.

The arrangement of FIG. 3 produces radially outward motion of the labyrinth traversing element 26, when portion 12 moves clockwise with respect to portion 10.

Figure 4:
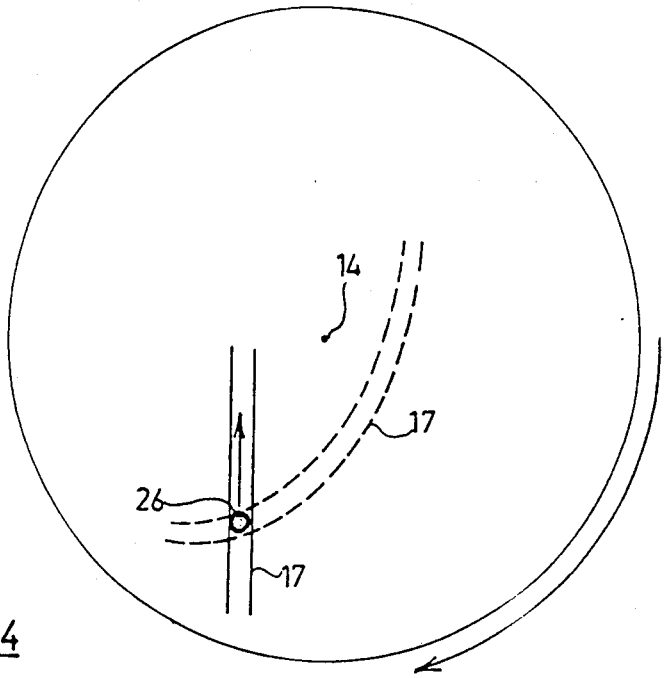
FIG. 4 is a diagrammatic illustration of another portion of a variable path.

The arrangement of FIG. 4 produces radially inward motion of the labyrinth traversing element 26, when portion 12 moves clockwise with respect to portion 10.

Figure 5:
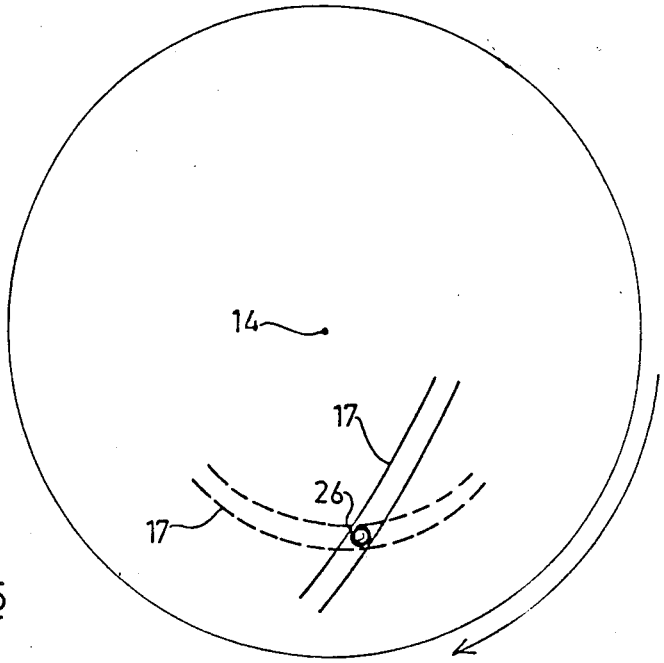
FIG. 5 is a diagrammatic illustration of still another portion of a variable path.

The arrangement of FIG. 5 produces zero radial motion of the labyrinth traversing element 26, when portion 12 moves clockwise with respect to portion 10.

Figure 6:
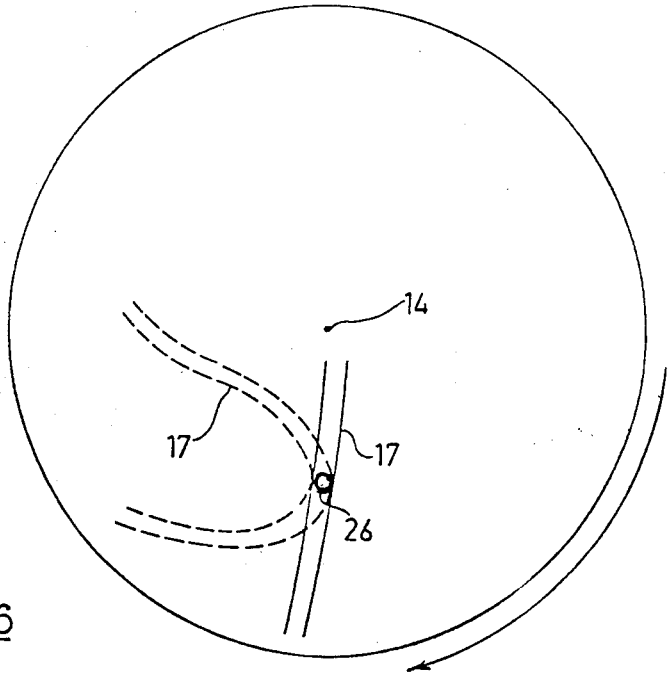
FIG. 6 is a diagrammatic illustration of yet another portion of a variable path.

The arrangement of FIG. 6 produces locking of portions 12 and 10 against further clockwise rotation of portion 12 with respect to portion 10. Further motion can only be produced by counterclockwise rotation of portion 12 with respect to portion 10.

Figure 7:
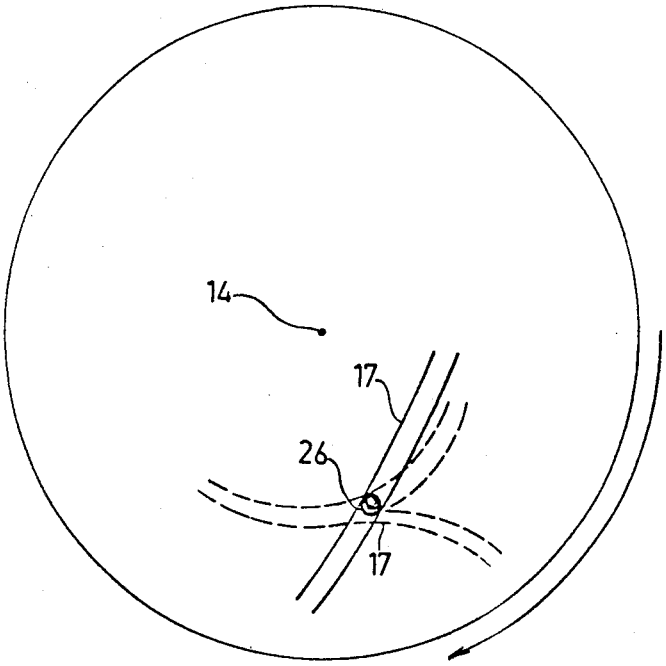
FIG. 7 is a diagrammatic illustration of still another portion of a variable path.

The arrangement of FIG. 7 presents a choice of inward or outward radial motion of the labyrinth traversing element 26, when portion 12 moves clockwise with respect to portion 10. The selection can be made by the player by any suitable technique, such as shaking or hitting the apparatus, the use of a magnet to guide a magnetically responsive labyrinth traversing element, or employing gravity by suitable orientation of the apparatus.

It is appreciated that the intersection shown in FIG. 7 may have more than two alternative legs.

Figure 8:
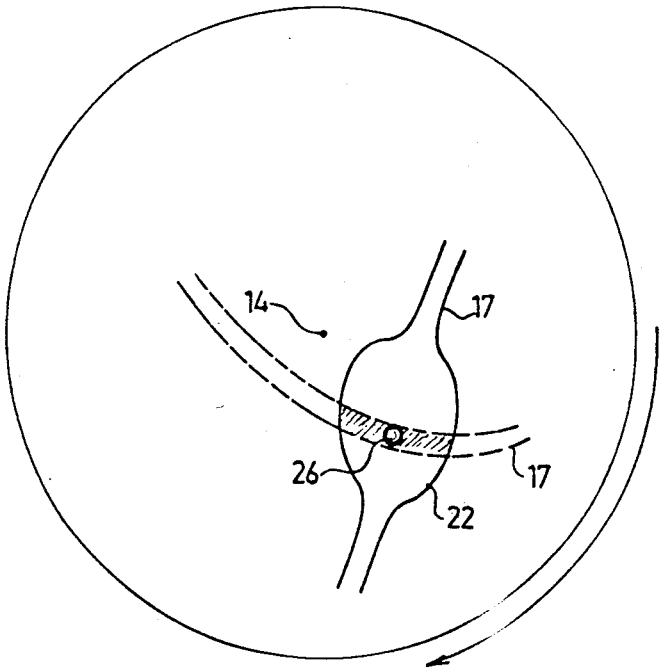
FIGS. 8, 9 and 10 are diagrammatic illustrations of three alternative embodiments of variable paths including broadened portions.

The arrangement of FIG. 8 provides a broadened groove portion 22 on one of the partial grooves, here portion 10. Thus the labyrinth traversing element 26 is free to move within the region defined by the broadened groove 22 and is constrained only by the partial groove formed in portion 12.

Figure 9:
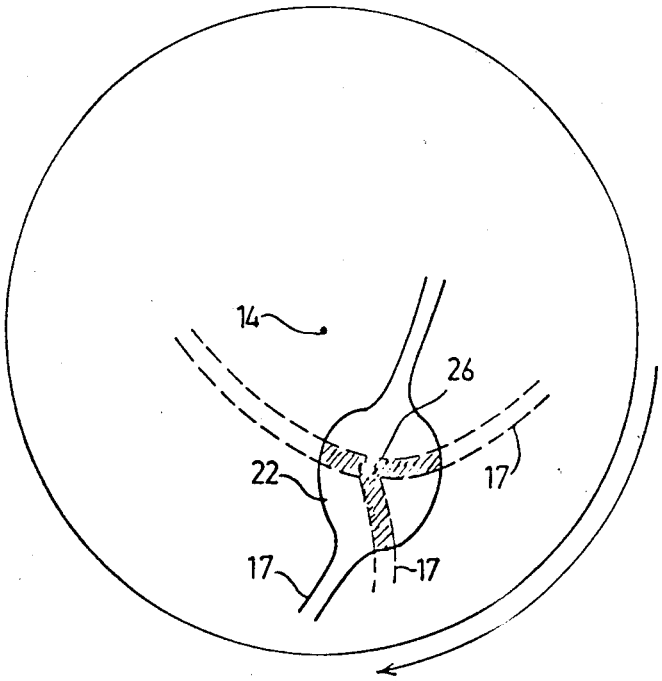

The arrangement of FIG. 9 is similar to that of FIG. 7 and defines an intersection in the groove formed on portion 12 which coincides with a broadened groove 22 formed in element 10, thus providing a selectable direction of movement of the labyrinth traversing element 26. Selection may be achieved by any of the techniques described hereinabove in connection with FIG. 7 but is relatively easier than in the arrangement of FIG. 7.

Figure 10:
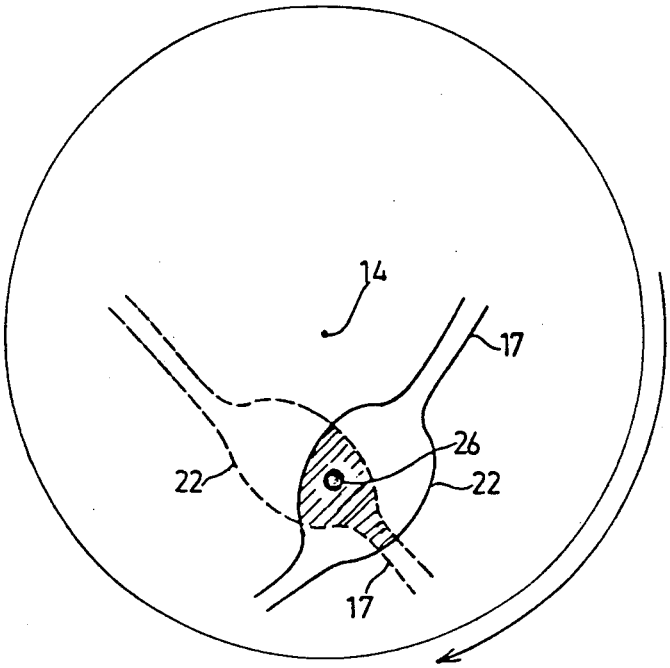

The arrangement of FIG. 10 comprises overlapping broadened grooves 22. The labyrinth traversing element 26 is free to move within the overlapping broadened regions.

It will be appreciated by persons skilled in the art that portions 10 and 12 may be interchanged and that the directions of relative rotation have been selected for illustration at random.

Figure 11:
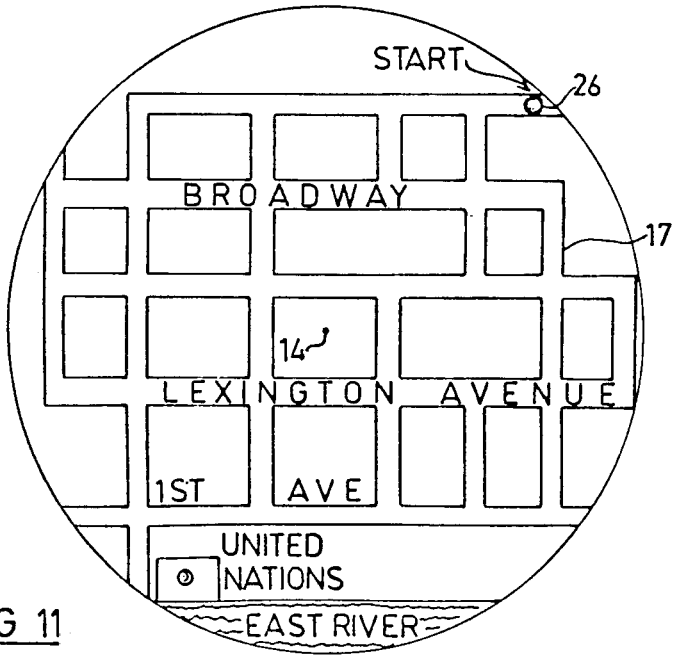
FIG. 11 is a pictorial illustration of an alternative labyrinth configuration.

Portions 10 and 12 and the grooves formed therein may be transparent or opaque. According to a preferred embodiment of the invention, the upper portion is opaque except for the grooves, which are transparent and define a pattern. In this embodiment, the puzzle is made more difficult because the player cannot see the entirety of both partial groove portions at any given time. One such pattern may be a pattern of lakes and rivers, as shown in FIG. 1. An alternative example is a pattern of streets, as shown in FIG. 11.

Figure 12A:
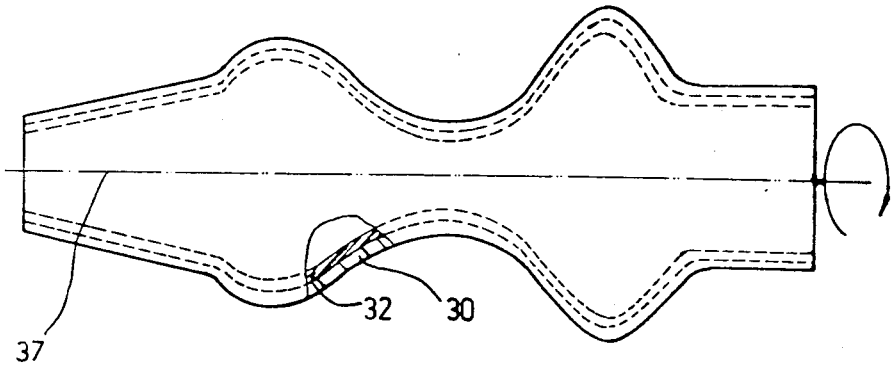
FIGS. 12A and 12B are respective side and sectional view illustrations of an alternative embodiment of a labyrinth puzzle.
Figure 12B:
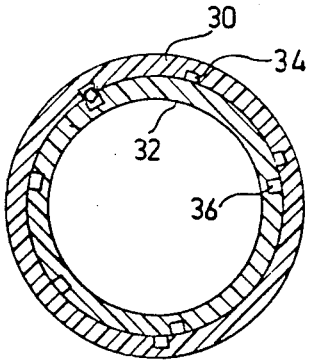

Reference is now made to FIGS. 12A and 12B, which illustrate an alternative embodiment of a labyrinth puzzle comprising first and second concentric elements 30 and 32 defining juxtaposed surfaces of rotation on which are formed grooves 34 and 36 respectively, preferably in the form of partial grooves, as defined hereinabove. The design and operation of the puzzle follows the same principles described hereinabove with the exception that here, the surfaces in which the grooves are formed are not flat. The puzzle is operated by relative rotation of the inner and outer elements 30 and 32 about their common axis of rotation 37.

Figure 13A:
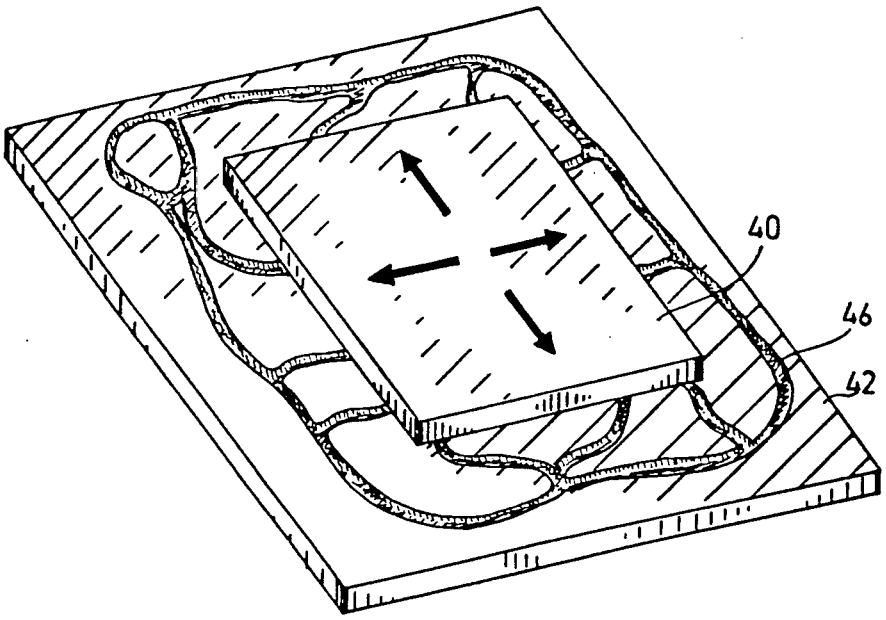
FIGS. 13A and 13B are respective pictorial and sectional view illustrations of a further alternative embodiment of a labyrinth puzzle.
Figure 13B:
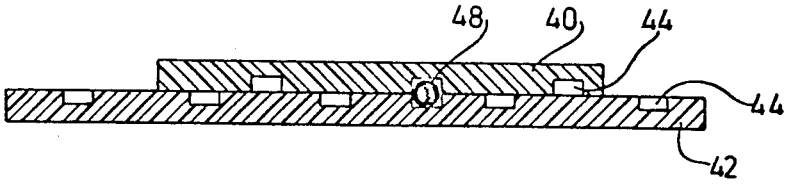

Reference is now made to FIGS. 13A and 13B which illustrate a further alternative embodiment of the present invention wherein two labyrinth portions are arranged for relative motion in a plane but are not restricted to relative rotation, as in the preceding embodiments. Here portions 40 and 42 are formed with grooves 44 and 46 respectively, preferably partial grooves as defined hereinabove, and are arranged for relatively free relative motion in a given plane, whereby a labyrinth traversing element 48 is caused to progress along a labyrinth. It is noted from FIG. 13A, that the two portions 40 and 42 need not be coextensive.

It will be appreciated by persons skilled in the art that the present invention is not limited by what has been particularly shown and described hereinabove. Rather the scope of the invention is defined only by the claims which follow:

We claim:

1. A variable path labyrinth puzzle comprising first and second labyrinth defining portions which are movable with respect to each other about a common axis, said first and second labyrinth defining portions defining respective first and second facing surfaces, having formed thereon respective non-identical groove patterns, which together define said variable path which is formed of a plurality of sequentially defined, mutually overlapping areas at which the non-identical first and second groove patterns overlap at a plurality of different relative orientations of the first and second portions as the first and second portions are rotated with respect to each other, a labyrinth traversing element located in said variable path and being configured with dimensions such that it can pass only mutually overlapping areas of said non-identical groove patterns, said first and second groove patterns including groove portions which are not entirely circumferentially directed and which are configured to cooperate in displacing said labyrinth traversing element along said variable path in response to relative rotation of said first and second labyrinth defining portions, said first and second groove patterns also including groove portions configured in a curved not-entirely circumferential configuration which produce locking interaction between the labyrinth traversing element and the first and second portions against continued rotation in a given direction, whereby traversal by the labyrinth traversing element of the variable path is effected only by successive relative rotations of the first and second portions in predetermined directions and predetermined steps.

2. A variable path labyrinth puzzle according to claim 1 and wherein at least one of the first and second labyrinth defining portions is hidden from the view of the player.

3. A variable path labyrinth puzzle according to claim 1 and wherein said labyrinth traversing element is magnetic and movable through the labyrinth with the aid of a magnet.

4. A variable path labyrinth puzzle according to claim 1 and wherein a plurality of labyrinth traversing elements are associated with the labyrinth at a given time.

* * * * *